US009521887B2

(12) United States Patent
Acton

(10) Patent No.: US 9,521,887 B2
(45) Date of Patent: Dec. 20, 2016

(54) SPECTATOR CELEBRATION SYSTEM

(71) Applicant: Robert Acton, Glen Burnie, MD (US)

(72) Inventor: Robert Acton, Glen Burnie, MD (US)

( * ) Notice: Subject to any disclaimer, the term of this patent is extended or adjusted under 35 U.S.C. 154(b) by 0 days.

(21) Appl. No.: 15/207,602

(22) Filed: Jul. 12, 2016

(65) Prior Publication Data

US 2016/0316837 A1 Nov. 3, 2016

Related U.S. Application Data

(63) Continuation-in-part of application No. 14/249,783, filed on Apr. 10, 2014.

(60) Provisional application No. 61/810,652, filed on Apr. 10, 2013.

(51) Int. Cl.

| | |
|---|---|
| ***A41F 9/00*** | (2006.01) |
| ***A44C 15/00*** | (2006.01) |
| ***A41D 27/08*** | (2006.01) |
| *A44B 11/25* | (2006.01) |

(52) U.S. Cl.

CPC ..... *A44C 15/0015* (2013.01); *A41D 27/085* (2013.01); *A41F 9/00* (2013.01); *A41F 9/002* (2013.01); *A44B 11/2565* (2013.01)

(58) Field of Classification Search

CPC ..... A44C 15/0015; A41F 9/00; A41F 9/002; A21D 27/085; A44B 11/2565

See application file for complete search history.

(56) References Cited

U.S. PATENT DOCUMENTS

| | | | | |
|---|---|---|---|---|
| 4,570,206 | A | 2/1986 | Deutsch | |
| 7,942,543 | B2 | 5/2011 | Ritter | |
| 2005/0030612 | A1 | 2/2005 | Yamazaki et al. | |
| 2007/0058361 | A1* | 3/2007 | Sevilla, II | A44B 11/001 362/103 |
| 2007/0116316 | A1* | 5/2007 | Goldberg | G10H 1/0025 381/370 |
| 2014/0098523 | A1 | 4/2014 | Sutton | |

* cited by examiner

*Primary Examiner* — David V Bruce
(74) *Attorney, Agent, or Firm* — Dale J. Ream

(57) ABSTRACT

A spectator celebration system includes a plurality of celebration devices, each having a belt selectively attached to a user's waist and an emblem mounted to the belt. An electronics compartment coupled to the emblem defines an interior area for holding a battery and a controller electrically connected to the battery is programmed with light and sound data. A plurality of lights in data communication with the controller is spaced apart on the belt. A speaker is operatively coupled to one of the emblem or belt and electrically connected to the controller such that the speaker emits sound data when actuated by the controller. A toggle switch is in data communication with the controller and electrically connected to the plurality of lights for manual control over light actuation. A receiver is in data communication with the controller for selectively receiving an activation signal from a remote transmitter.

7 Claims, 6 Drawing Sheets

SPECTATOR CELEBRATION SYSTEM

REFERENCE TO RELATED APPLICATIONS

The present application is a continuation in part of U.S. patent application Ser. No. 14/249,783 filed Apr. 10, 2014 and titled "Touchdown Belt," which claims the benefit of provisional patent application U.S. Ser. No. 61/810,652 filed Apr. 10, 2013 titled "Touchdown Belt," which is incorporated herein by reference.

FIELD OF THE INVENTION

The present invention pertains to the field of sports and, more particularly, to the field of light emitting accessories for sports fans. Still more specifically, the present invention is directed to a belt having light and sound accessories configured to celebrate a touchdown or other sports achievement.

BACKGROUND OF THE INVENTION

Showing support for one's favorite team is an engrossing part of any sports fan's regular routine. People advertise their support of different teams and players, a behavior which allows an ardent fan to develop a specific personal relationship with the involved team. All types of different promotional ephemera related to sporting teams have developed as a result of this infatuation, from giant foam fingers and banded sports jerseys to posters and bobble head dolls honoring prolific players. Tuning into the pervading ethic of one's team is a great way to find recognition in an existent community and to encourage one's family, friends and coworkers to get on the bandwagon. Supporting a local team is an important part of integrating oneself into a community at large. As cheering on sports teams during regular events is an important part of the social fabric in many different communities, participation in this regular exuberance is an emotionally beneficial pastime for all manner of committed fans.

Celebrating scoring is perhaps the most exuberant part of any sports fanaticism. Whenever a favored team manages to secure one or more points, its fans are programmed to celebrate with one another in the stands or in front of their television sets at home. Further encouragement like fireworks, sirens, flashing lights and other distractions are built right into the fabric of the game, encouraging an attitude of rampant celebration whenever scoring occurs. This persistent stimulation leads fans to embrace all manner of useful devices capable of further broadcasting their ebullient exhilaration to everyone in the local vicinity. From compressed air powered horns to large and gaudy banners, these devices help to reinforce the attitude that winning is everything and the selected team is ultimately destined to win. Encouraging fan participation in goal celebrations is an important part of inculcating a codependent relationship between players and fans. Every professional sports team benefits from encouraging greater and more effervescent celebration by its supporters whenever a goal is secured.

The present invention, hereinafter referred to as the Touchdown Belt, provides dedicated fans with a simple and effective accessory to broadcast their celebration upon witnessing a scoring. Wearing a Touchdown Belt emits a spectacular light and sound show to all members within the wearer's immediate vicinity. The Touchdown Belt provides an appealing and visible way for sports fans to show support for their selected team and to vibrantly participate in post goal or post game celebrations. The Touchdown Belt incorporates the latest in modern light emitting diode and sound technology to ensure that fan celebration is easily and effectively broadcast to anyone in visible range.

The prior art has put forth several designs for light emitting accessories. U.S. Pat. No. 4,570,206 to Claude Deutsch describes an electrically controlled optical display apparatus for embellishing or decorating a design on a garment. A removable display apparatus has lamps and electrical connectors disposed in a composite removable patch on an inside the garment. The lamps project outside the garment and are held by elastic clamping members surrounding the luminous heads of the lamps.

US Patent to 2005/0030612 to Shunpei Yamazaki and Noriko Shibata describes a process of successively forming from an EL layer, a cathode, a barrier layer and a cover layer in the same multi chamber. The EL layer, cathode, barrier layer and cover layer are formed in the same multi chamber in succession by using a same film deposition method to form the EL layer and the cover layer. A sealed structure of an EL element is formed.

U.S. Pat. No. 7,942,543 to Michael Larry Ritter describes a light emitting head accessory including an array of light emission devices positioned on a front surface of a strip of flexible material, a logic circuit, a power source, and an input device. The logic circuit is connected to the array of light emission devices and programmed to create arrangements on the array of light emission devices by illuminating a plurality of light emission devices in the array of light emission devices. The power source provides power to the array of light emission devices and the logic circuit. The input device is connected to and instructs the logic circuit to display various arrangements on the array of light emission devices.

Although presumably effective for their intended purposes, the existing devices and proposals do not present a wearable accessory, such as a belt, having a plurality of lights and control circuitry capable of selectively energizing the lights in selected patterns or include sound capabilities when energized. Therefore, it would be desirable to have a spectator celebration system having one or a plurality of wearable celebration devices each having lights and a speaker in communication with a controller under manual control via an electrically connected toggle switch. Further, it would be desirable to have a spectator celebration system having a plurality of celebration devices, each having a receiver configured to receive an activation signal from a remote transmitter, respective controllers being configured to energize respective lights and sound on respective celebration devices simultaneously upon receiving the activation signal.

SUMMARY OF THE INVENTION

A spectator celebration system according to the present invention includes a celebration device having a belt selectively attached to a user's waist and an emblem adorned with a screen printed image of a team logo mounted to a front of the belt. An electronics compartment is coupled to the emblem defining an interior area for holding a battery and a controller electrically connected to the battery, the controller being programmed with light and sound output data. A plurality of lights in data communication with the controller is spaced apart on a front of the belt. A speaker is operatively coupled to one of the emblem or the belt and electrically connected to the controller such that the speaker selectively emits respective sound data when actuated by the controller.

A toggle switch is in data communication with the controller and electrically connected to the plurality of lights.

In another aspect, each celebration device may include a receiver in data communication with the controller and configured to receive an activation signal that had been emitted from a remote transmitter, the controller configured to actuate the lights and sound upon receiving the activation signal. It is understood that the spectator celebration system may include a plurality of celebration devices—all of which are configured to be activated simultaneously upon receiving the same activation signal from the remote transmitter, such as while all being present and worn by fans at a football game or other similar event.

Therefore, a general object of this invention is to provide a spectator celebration system that overcomes the limitations of the prior art and provides the functionality conducive for fan celebration and support of their favorite team as will be described below.

Other objects and advantages of the present invention will become apparent from the following description taken in connection with the accompanying drawings, wherein is set forth by way of illustration and example, embodiments of this invention.

DETAILED DESCRIPTION OF THE INVENTION

Figure 1:
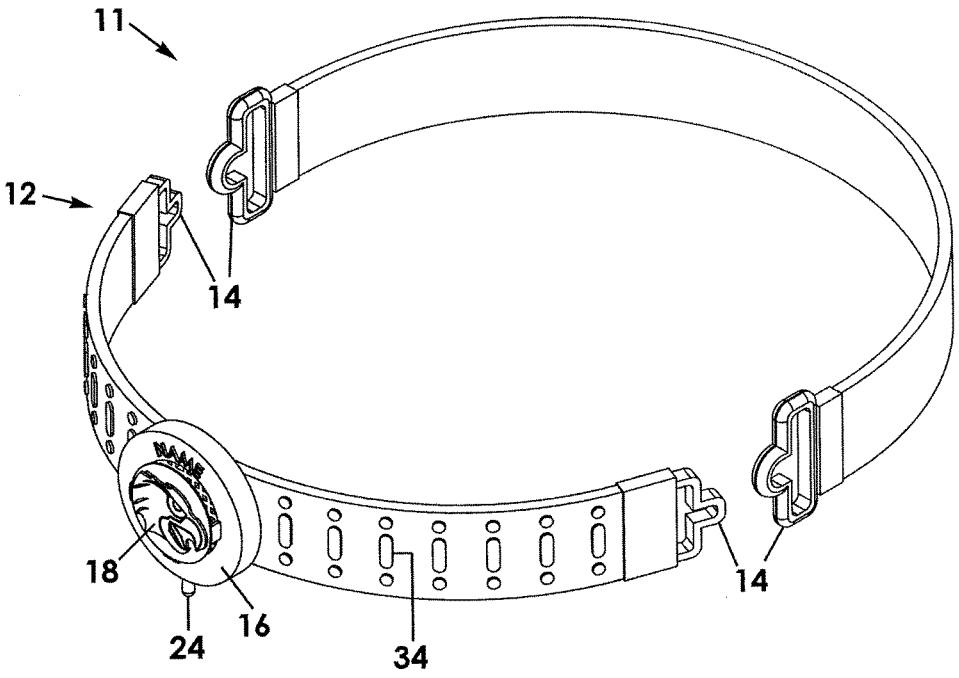
FIG. 1 is a perspective view of a celebration device in the form of a belt of a spectator celebration system according to a preferred embodiment of the present invention.
Figure 2:
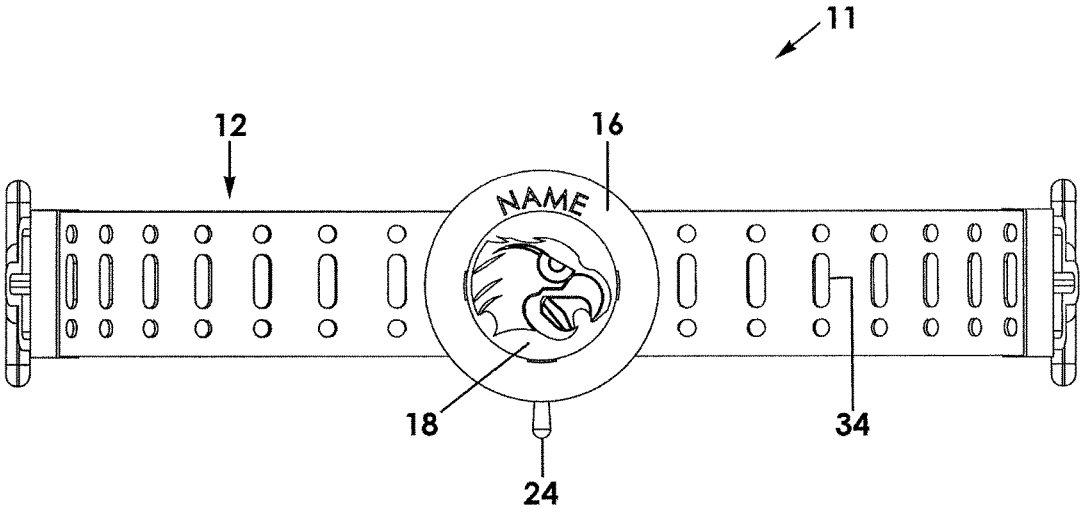
FIG. 2 is a front view of the celebration device as in FIG. 1.
Figure 3A:
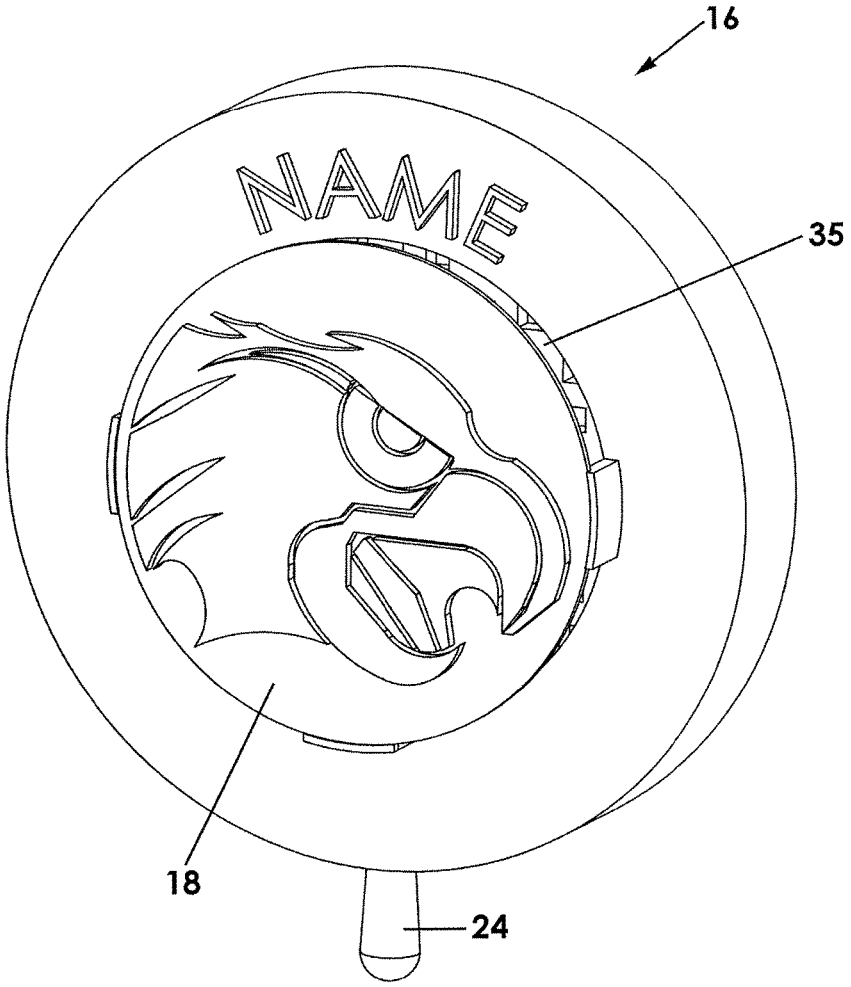
FIG. 3*a* is an isolated view on an enlarged scale of the emblem removed from the belt.
Figure 3B:
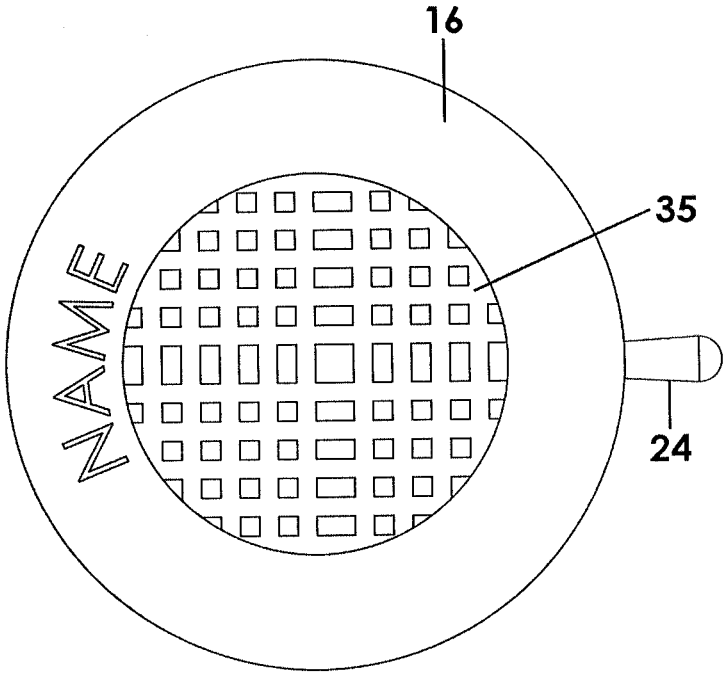
FIG. 3*b* is a front view of the emblem as in FIG. 3*a* with the team logo portion removed to reveal a speaker.
Figure 3C:
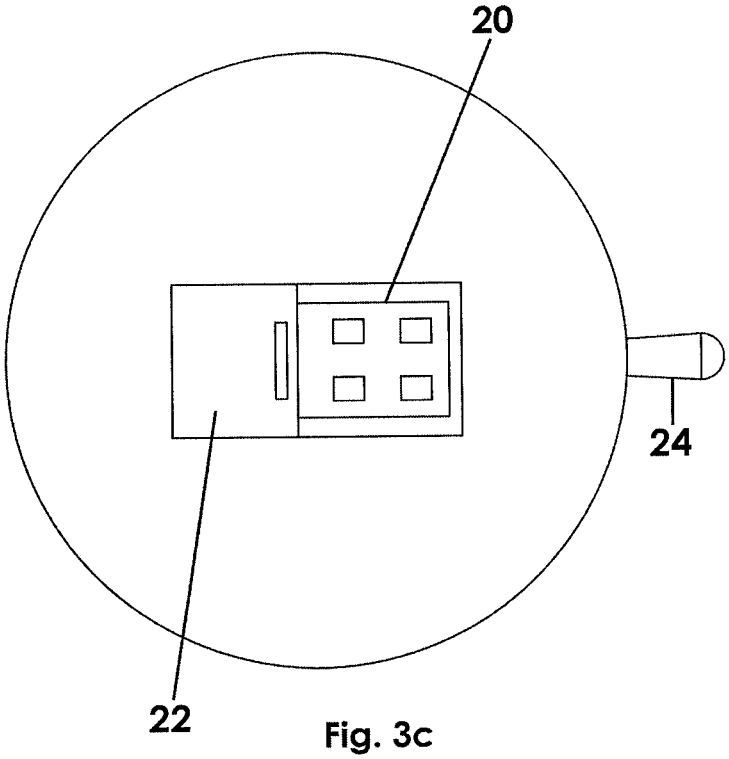
FIG. 3*c* is a rear view of the emblem as in FIG. 3*a* illustrating a compartment door in an open configuration.
Figure 4A:
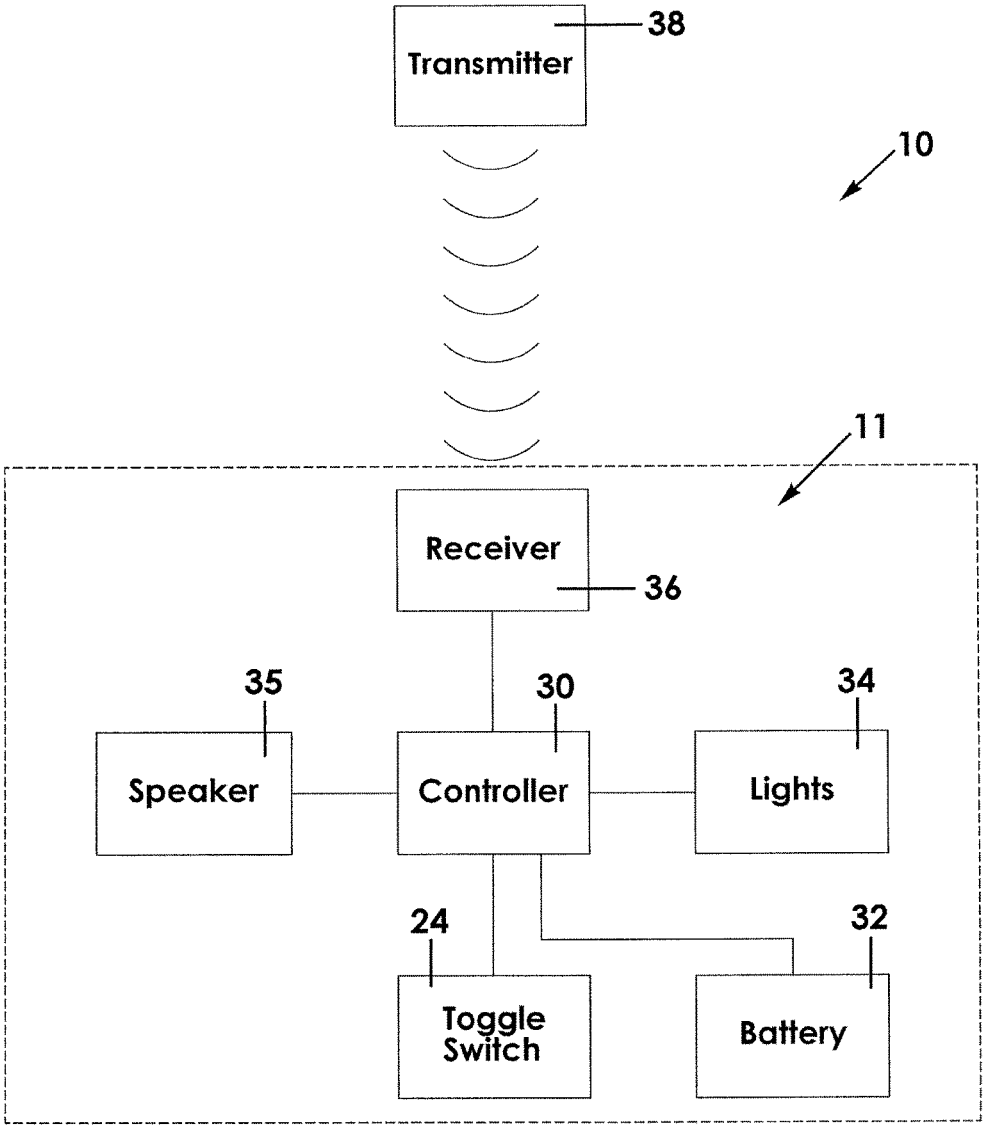
FIG. 4*a* is a block diagram illustrating the spectator celebration system according to the present invention.
Figure 4B:
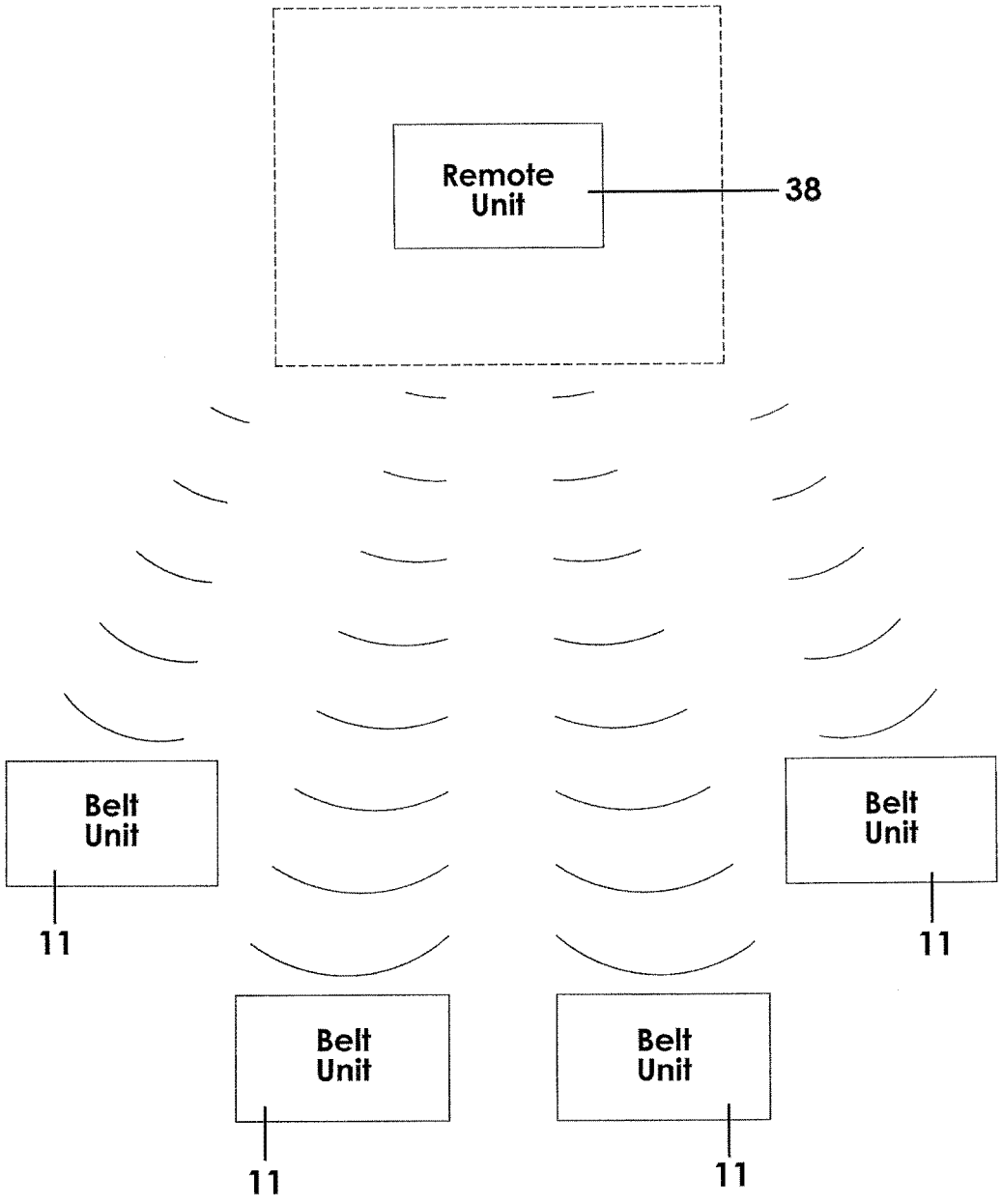
FIG. 4*b* is another block diagram illustrating the spectator celebration system according to the present invention.

A spectator celebration system according to a preferred embodiment of the present invention will now be described with reference to FIGS. 1 to 4*b* of the accompanying drawings. The spectator celebration system 10 includes one or a plurality of celebrations devices 11, each having a belt 12 (also referred to as a "Touchdown Belt") selectively securable about the waist of a person.

The highly visible and functional "Touchdown Belt" 12 is constructed from plastic, elastic, nylon, or leather with two opposed secure metal or plastic clasps or clips 14 that cooperate to selectively move the belt between secured and released configurations. The belt includes a central emblem 20 may have a logo portion 18 adorned with a screen printed image of the team's logo. The logo portion 18 of the emblem 16 may be outwardly offset so as to enable sound from a speaker 35 to be emitted more effectively, as will be described in more detail later. This emblem 16 defines a small recessed compartment capable of holding a lithium battery 32. In an embodiment, an electronics compartment 20 may be coupled to a rear of the emblem 16 and configured to selectively hold the battery 32 and other electronic components that will be described later. This compartment is protected by a small snap on closure or door 22 that is easily opened, so a battery 32 may be replaced easily by hand.

Power leads from this small battery 32 may be connected to small toggle switch 24 on the lower face of the emblem's front which is connected to light emitting diode (LED) arrays 34 extending away from the emblem 16 in both directions on the upper and lower edges of the belt's material. These LED arrays 34 are woven directly into the material of the belt 12, but are exposed enough to remain visible to onlookers. They colors of the various LEDs in the design may be selected to match the dominant colors of the team being promoted. The LEDs are wired to light up in sequence, moving from one to the next, which creates the illusion of movement from the belt emblem 16 out to the edges of the arrangement. Various different patterns of flashing and movement are possible. These patterns are swapped by simply flipping the present invention's toggle switch 24 back and forth. Each time the present invention is turned on, it cycles to the next available display pattern, ensuring that those who are observing the user never find the display monotonous or annoying.

Using the Touchdown Belt 12 is easy. First, the user locates and purchases a belt 12 that is appropriately adorned to recognize the prowess of whichever team the user supports. These belts 12 may be available for purchase at a fan store in a local area or an online retailer specializing in sports fan paraphernalia. The Touchdown Belt 12 is available in extra small, small, medium, large and extra large sizes. Once an appropriately sized Touchdown Belt is acquired, a user purchases batteries and secures them in the battery compartment 20 on the rear of the belt buckle. Once the belt 12 is thus arrayed, it is secured about one's waist. The Touchdown Belt may be worn inside the belt loops of a regular pair of pants. Relying on simple tension to keep it properly located on a user's frame, the present invention also is wearable on the outside of one's outfit.

With the belt so attached, the user now is ready to participate in observing a game, either in person at a sports arena or from a comfortable seat in front of a television at home or with friends. Whenever the user's favored team scores a goal, the wearer flips the Touchdown Belt's toggle switch 24, causing a cascade of delightful colors to flow forth and illuminate the immediate area and encouraging a general level of exhilaration throughout the gathered celebrants. Once the celebratory moment has waned, the wearer switches the toggle switch 24 to its "Off" position and the belt's vibrant light display ceases. Upon the next scoring incidence, the wearer switches the toggle switch 12 to an "On" position again, causing pulsing and flashing in a different yet equally celebratory manner.

In another aspect, the touchdown belt 12 includes a receiver 36 configured to receive an activation signal emitted from a remote transmitter 38 that is configured to transmit an activation signal. The receiver 36 may be positioned in the electronics compartment 20 and electrically connected to the battery 32. In addition, a speaker 35 may be positioned in the electronics compartment and electrically connected to the battery 32. All of the aforementioned components may be electrically connected to a controller 30, or equivalent circuitry or even a microprocessor, including the toggle switch 12 described above. The controller 30 may be programmed to operate the LED arrays 34 upon operation of the toggle switch 24. Further, the controller 30 may be programmed to receive input from the receiver 36 and, as appropriate energizes the LED arrays 34 to illuminate and the speaker to emit a predetermined sound or audio stream.

More particularly, it is intended that a plurality of fans in a sporting venue, such as a football stadium, will be wearing a celebration device 11 with Touchdown Belt 12 simultaneously such that when a touchdown is scored by the home team, a technician will actuate the remote transmitter 38 (which may be enclosed in a "Remote Unit" (FIG. 4*b*) to transmit an activation signal and that respective receivers 36 of all of the celebration devices 11 will receive simultaneously. Respective controllers 30 are configured, when respective actuation signals are received, to energize respective lights 34 or speakers 35 or both to emit light sound output. For instance, predetermined light patterns may be actuated and predetermined sounds, such as a team fight song, may be emitted. The type of light pattern may be varied by a user operation of the toggle switch 24 as described above.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A spectator celebration system for showing support for a favorite team, comprising:

a celebration device, including:

a belt having opposed ends each end having a fastener such that said belt is selective coupled about a user's waist;

an emblem adorned with a screen printed image of a team logo mounted to a front of said belt;

an electronics compartment coupled to said emblem defining an interior area for holding a battery and a controller electrically connected to said battery, said controller being programmed with light and sound output data;

a plurality of lights spaced apart on a front of said belt and forming LED arrays extending away from the emblem in both directions, said plurality of lights being in data communication with said controller;

a speaker operatively coupled to one of said emblem or said belt and electrically connected to said controller wherein said speaker selectively emits respective sound data when actuated by said controller;

a toggle switch on the lower face of the front of the emblem, said toggle switch in data communication with said controller and electrically connected to said plurality of lights;

wherein said plurality of lights are configured to light up in sequence when actuated by said controller, moving from one to the next so as to create the illusion of movement from said emblem out to the edges of said LED arrays.

2. The spectator celebration system as in claim 1, wherein said celebration device includes a receiver positioned in said compartment and in data communication with said controller, said receiver configured to receive an activation signal and to deliver said received signal to said controller, said controller programmed to actuate said plurality of lights and said speaker upon receipt of said activation signal.

3. The spectator celebration system as in claim 2, further comprising a transmitter remote from said celebration device configured to selectively emit an activation signal.

4. The spectator celebration system as in claim 3, further comprising a plurality of celebration devices, wherein respective receivers from respective celebration devices are configured to simultaneously receive said activation signal and respective controllers are configured to simultaneously actuate respective lights and respective speakers when respective receivers are in receipt of said activation signal.

5. The spectator celebration system as in claim 1, wherein said LED arrays are woven directly into said belt and are exposed enough to remain visible to onlookers.

6. The spectator celebration system as in claim 3 wherein said LED arrays include colors of the dominant colors of a sports team.

7. The spectator celebration system as in claim 1, wherein the belt is constructed from plastic, elastic, nylon, or leather.

* * * * *